United States Patent [19]

Heilman et al.

[11] 4,018,695

[45] Apr. 19, 1977

[54] POLYMER-MODIFIED AUTOMATIC TRANSMISSION FLUID

[75] Inventors: William J. Heilman, Allison Park; Thomas J. Lynch, Pittsburgh, both of Pa.

[73] Assignee: Gulf Research & Development Company, Pittsburgh, Pa.

[22] Filed: Feb. 2, 1976

[21] Appl. No.: 654,325

Related U.S. Application Data

[63] Continuation of Ser. No. 448,069, March 4, 1974, abandoned.

[52] U.S. Cl. ..... 252/73; 252/59

[51] Int. Cl.[2] ..... C10M 1/18

[58] Field of Search ..... 252/73, 59

[56] References Cited

UNITED STATES PATENTS

| | | | |
|---|---|---|---|
| 2,525,788 | 10/1950 | Fontana et al. | 252/59 |
| 2,895,915 | 7/1959 | Hewett et al. | 252/59 |
| 3,477,957 | 11/1969 | Hall | 252/59 |
| 3,551,336 | 12/1970 | Jacobsson et al. | 252/59 |
| 3,795,616 | 3/1974 | Heilman et al. | 252/59 |

*Primary Examiner*—Harris A. Pitlick

[57] ABSTRACT

Compounded automatic transmission fluids having improved properties, including shear and viscosity properties, are obtained by the incorporation therein of alpha-olefin polymers of controlled molecular size and narrow molecular weight distribution. A shear stable, automatic transmission fluid having excellent high and low temperature viscosity properties and improved pour point is produced by adding the copolymer of 1-hexene and 1-octadecene to a lubricating oil.

6 Claims, No Drawings

POLYMER-MODIFIED AUTOMATIC TRANSMISSION FLUID

This is a continuation of application Ser. No. 448,069 filed Mar. 4, 1974, abandoned.

The present invention relates to novel, shear stable automatic transmission fluid compositions of improved viscosity characteristics and improved pour point comprising a multifunctional alpha-olefin polymer of controlled molecular size and narrow molecular weight distribution. More particularly, the invention relates to novel, shear stable automatic transmission fluid compositions containing an alpha-olefin polymer of an alpha-olefin copolymer of a lower alpha-olefin such as 1-hexene and a higher alpha-olefin such as 1-octadecene of controlled molecular size and narrow molecular weight distribution. This copolymer significantly enhances both the high temperature and low temperature viscosity characteristics of the automatic transmission fluid while maintaining substantial shear stability as determined by established ASTM testing procedures and the copolymer, in addition, significantly reduces the pour point of the fluid.

Automatic transmission of the type which are used in passenger vehicles and trucks require carefully formulated fluids for the internal lubrication of the automatic transmission and for the internal transmission of energy. Since these fluids are subjected to severe conditions of use for long periods of time without change, exacting specifications have been developed covering their chemical and physical properties. An automatic transmission fluid is generally formulated as a blend of highly refined lubricating oil base stocks and brought to specification by the use of a suitable combination of additives for a controlled balance of properties. These properties include suitable high and low temperature viscosity characteristics and suitable shear stability. The specifications for automatic transmission fluids of the General Motors Corporation (GM 6032M) and The Ford Motor Company (ESW-M2C33-E or F) are the most widely used in the industry. Any automatic transmission fluid which can meet both specifications is suitable for general use.

Both the General Motors and the Ford Motor specifications require a minimum initial (unused) viscosity at 210° F. (98.9° C.) of 7.0 cs. (ASTM D445). Additionally, the General Motors specification requires a maximum Brookfield viscosity at −40° F. (−40° C.) of 55,000 cp. (ASTM D2983) while the Ford specification requires a minimum used viscosity at 210° F. (98.9° C.) of 6.2 cs. as determined by a sonic shear test (ASTM D2603) and a maximum pour point of −40° F. (−40° C.) (ASTM D97). The General Motors specification also requires that the Brookfield viscosity at −10° F. (−23.3° C.) be a maximum of 4,000 cp. and the Ford specification requires that the maximum viscosity (ASTM D445) at 0° F. (−17.8° C.) be 1,400 cp., however, these latter two specification items are of lesser overall significance because they will generally be met if these other viscosity items are met.

Unmodified lubricating oil base stocks cannot meet the rigorous viscosity requirements of these specifications. Viscosity modifying additives must therefore be used to bring the lubricating oil base stock up to these specifications for automatic transmission fluids. However, meeting these specification requirements is not a simple matter. In illustration of this problem, a typical lubricating oil base stock having a viscosity of 4.1 cs. at 210° F. (98.9° C.) can be considered. When this base stock is modified with 10 percent of a commercially used detergent inhibitor combination and one percent of a commercial pour point depressant, it has a 210° F. (98.9° C.) viscosity of 4.5 cs. and a −40° C.) Brookfield viscosity of 31,000 cp. To meet the combined General Motors and Ford Motor viscosity specifications, the 210° F. (98.9° C.) viscosity of this modified base stock must be increased 56 percent to 7.0 cs. while the −40° F. (−40° C.) viscosity cannot be increased by more than 25 percent to 55,000 cp. Since the shear instability in an automatic transmission fluid results primarily from the viscosity modifier, this viscosity modifier must additionally be substantially shear stable otherwise it will cause a viscosity reduction below 6.2 cs. at 210° F. (98.9° C.) as determined by the sonic shear test.

It readily becomes apparent that a desirable viscosity modifier for automatic transmission fluids must have excellent viscosity-temperature characteristics as well as excellent inherent shear stability if these automatic transmission fluid specifications are to be met. Since lube oils containing high molecular weight polymers do not faithfully respond to low temperature extrapolation on the ASTM D341 chart, viscosity index is not a reliable indicator of the low temperature properties of the polymer modified oil. Rather the viscosities must be determined by actual measurement in accordance with the automatic transmission fluid specifications.

The pour point of an automatic transmission fluid is another characteristic which determines the fluid's usefulness in automatic transmissions in the colder climates. The fluid's pour point in an approximate indication of the lowest temperature at which the fluid can be poured or removed from containers, as well as the minimum saft temperature at which it will flow and circulate readily within automatic transmissions. Although the pour point is only a general indicator of the low temperature flow properties, it is used in most specifications for this purpose. The pour point is determined by ASTM D97. Most oils, and particularly the paraffinic base oils, require a pour point depressant as an additive in order to meet the established automatic transmission fluid specifications.

Heretofore, special polymeric viscosity modifiers have been incorporated into petroleum based lubricating oils or have been suggested for incorporation into these oils for the intended purpose of improving their inherent viscosity-temperature characteristics for use as automatic transmission fluids. These materials include polyisobutylenes, polyacrylates, polyalkylstyrenes, polyalpha-olefins, ethylene-propylene copolymers and the like. However, these materials to varying degrees possess shear and/or low temperature viscosity problems.

We have discovered that a high quality, shear stable automatic transmission fluid that meets all of these high and low temperature viscosity and fluidity requirements can be prepared by adding to the fluid a minor amount of a poly(1-olefin) polymer of controlled molecular weight and molecular weight distribution. The resulting composition is shear stable and therefore will stay within specification for extended periods of use. It exhibits good viscosity characteristics at 210° F. (98.9° C.) and good −40° F. (−40° C.) viscosity as determined by a Brookfield viscometer. Since this −40° F. (−40° C.) Brookfield viscosity is determined after holding the fluid for 16 hours at test temperature, this test is believed to be a reliable indicator of the long term storageability of the fluid. Pour point depression is obtained as a further property of the polymer additive by incorporating a minor amount of a specific class of higher alpha-olefins into the polymer.

The poly(1-olefin) which we use is the polymer made from any single lower alpha-olefin monomer from 1-hexene to 1-decene and mixtures thereof. Since 1-hexene, 1-octene and 1-decene are readily available, these are the preferred olefins. The higher olefins which can be incorporated into the polymer for pour point depressancy are alpha-olefins selected from 1-hexadecene to 1-eicosene and mixtures of these 1-olefins. Since 1-hexadecene, 1-octadecene and 1-eicosene are commercially available, these are the preferred higher olefins, with 1-octadecene being the most preferred higher olefin. The straight chain olefins are also preferred, although some branching can be tolerated provided that it is not closer to the double bond than the four carbon atom. Also conventional impurities of other olefins such as five percent 1-dodecene in 1-decene are not objectionable. The most preferred copolymer of the lower and higher alpha-olefin is made from 1-hexene and 1-octadecene. The lower molecular weight 1-olefin, such as 1-hexene, comprises broadly from about 75 to about 90 mol percent of the copolymer and the higher molecular weight 1-olefin, such as 1-octadecene, broadly comprises from about 10 to about 25 mol percent of the copolymer for optimum pour point depressancy. If less than about 10 mol percent of the higher alpha-olefin is used in the copolymer, the viscosity modifying properties will be present in the copolymer but less than the optimum pour point depressing properties will be obtained. Preferably the lower molecular weight 1-olefin comprises from about 80 to about 88 percent of the copolymer and the higher molecular weight 1-olefin preferably comprises from about 12 to about 20 mol percent of the copolymer. The alpha-olefins of odd carbon numbers within the defined ranges are usable but are much less plentiful than the even-numbered carbon olefins.

The poly(1-olefins) can be described as a mixture of long straight chain molecules formed with a pendent group on alternating carbon atoms. Each pendent group will have two less carbon atoms than the alpha-olefin monomer from which it is derived. When a mixture of alpha-olefin monomers is used, the different alpha-olefins in the starting mixture randomly join together in the chain in essentially the same molar ratio that each alpha-olefin occurs in the initial mixture. Therefore, the possibility that any pendent group is from any specific 1-olefin is essentially the same as the mol percent of that 1-olefin in the starting mixture. Thus, when a starting mixture comprising 12 mol percent 1-octadecene and 88 mol percent 1-hexene is used, any specific pendent group will have a 12 percent chance of being a 16 carbon group and an 88 percent chance of being a four carbon group. And in any specific molecule of such copolymer essentially 12 percent of the pendent groups will be derived from 1-octadecene and 88 percent of the pendent groups will be derived from 1-hexene. The polymer chains terminate with hydrogen or with a double bond.

The pour point depression effected by the copolymer of the lower and the higher alpha-olefin as described herein can be accomplished within a wider range than the specified molar proportions of the lower and higher alpha-olefins. However, the required low temperature Brookfield viscosity can only be attained within the specified range of mol proportions. When deviations from the specified molar proportions occur, the fluid mixture can be a solid (Brookfield viscometer) at a higher temperature than its measured pour point. That is, the desired high temperature and low temperature viscosity modifying characteristics as well as shear stability are primarily related to the molecular size and molecular weight distribution of the polymer or copolymer while the desired pour point depressing effect as well as the desired low temperature viscosity characteristics of the copolymer are primarily related to the type and distribution of the lower and higher 1-olefins within the copolymer molecules. That the higher alpha-olefins would impart a pour-point depressant and a fluidity maintenance effect when incorporated into the copolymer together with the lower alpha-olefin is unexpected, particularly in view of the fact that homopolymers of the higher alpha-olefins do not significantly affect the pour point when used alone. Our discovery that the narrow range of the proportions of higher and lower alpha-olefins in the copolymer to effect suitable low temperature properties is also unexpected. When the higher alpha-olefin is not incorporated in the polymer, a separate pour point depressant may be required in the formulation of the automatic transmission fluid.

The high quality, shear stable, automatic transmission fluid is obtained under our invention when the molecular weight and the molecular weight distribution of the alpha-olefin copolymer additive are controlled within critical limits. High molecular weight organic polymers generally contain a mixture of molecules occurring over a vast range in molecular weight. This includes polymers of alpha-olefins. A high molecular weight polymer can be defined in terms of the weights and distribution of the molecules forming it by means of its weight average molecular weight $M_w$, its number average molecular weight $M_n$ and the distribution factor $M_w/M_n$. Values for these concepts, as represented by the specified symbols, provide a good indicator of the distribution of the molecules and molecular weights in the polymer and, as stated, are the basis for the definition of the useful alpha-olefin polymer and copolymer additives described herein.

We have determined that high quality, shear stable, automatic transmission fluids with excellent viscosity characteristics are obtained herein from 1-hexene polymers when the weight average molecular weight $M_w$ for poly(1-hexene) is between about 50,000 and about 500,000; its number average molecular weight $M_n$ is between about 4,000 and 500,000; and its distribution factor $M_w/M_n$ is between 1 and 12 with $M_w/M_n$ being between 1 and about 12 when $M_w$ is about 50,000 and being between 1 and about 2 when $M_w$ is about 500,000 with the upper range of the distribution factor proportionately increasing from about 2 to about 12 as the $M_w$ decreases from about 500,000 to about 50,000.

The critical values and ranges for $M_w$ and $M_n$ that are required to produce these specification automatic transmission fluids are a direct function of the molecular weight of the alpha-olefin monomer that is used to produce a homopolymer hereunder or the average molecular weight of the alpha-olefins in the monomer mixture that is used to produce the copolymer. We can therefore define the critical values of $M_w$ and $M_n$ for the other homopolymers and the copolymers defined herein by using the above values for 1-hexene, the molecular weight $M_o$ of the monomer or the average molecular weight $M_o$ of the comonomer mixture and the molecular weight 84 of 1-hexene. As an example, the average molecular weight of a copolymer prepared from a comonomer mixture comprising 12 mol percent 1-octadecene and 88 mol percent 1-hexene is about 104. Therefore, the equivalent values of $M_w$ and $M_n$ for this comonomer are the values of $M_w$ and $M_n$ for 1-hexene multiplied by the ratio 104/84. The equivalent values and ranges of $M_w$ and $M_n$ for all of the homopolymers and copolymers defined herein are obtained in an equivalent manner from the values and ranges for poly(1-hexene) set out above. In contrast, since the distribution factor is independent of the molecular weight of the alpha-olefins used, the critical values and ranges of the distribution factor are independent of the alpha-olefins used as well as the proportions used.

The lower the weight average molecular weight $M_w$ of a poly(1-olefin) the more shear stable is the automatic transmission fluid for an equivalent weight of polymer but more polymer is required to produce a suitable 210° F. (98.9° C.) viscosity with a proportionally greater increase in the 0° F. (−17.8° C.) and the −40° F. (−40° C.) viscosities. On the other hand the higher the weight average molecular weight $M_w$, the less polymer is required and the greater is the shear loss, but at equivalent shear loss the 0° F. (−17.8° C.) and −40° F. (−40° C.) viscosities will exhibit a proportionally lesser increase. Furthermore, the lower the distribution factor at the same weight average molecular weight, the less increase in 0° F. (−17.8° C.) and −40° F. (−40° C.) viscosity for a given amount added to a specific base oil to get a desired 210° F. viscosity and the less shear loss will occur.

The desired viscosity effects of the polymer upon the automatic transmission fluid is a function of the number of repeating units in the polymer regardless of the starting monomers or proportions that are used. Thus, we have determined that the weight percent of any polymer to be used in an automatic transmission fluid can be determined by reference to the amount of a different poly(1-olefin) known to be required, other factors being the same, using the monomer molecular weight relationship. We have determined that the range of addition of poly(1-hexene) required to obtain the desired viscosity effects is broadly from about 0.2 to about five weight percent. We can obtain the broad range of addition for any polymer herein by multiplying this range for poly(1-hexene) with the monomer molecular weight ratio $M_o/84$, described above. The preferred range of addition of poly(1-hexene) to the automatic transmission fluid is between about 0.5 to about 2.0 weight percent and the most preferred range is between about 0.5 to about 1.5 weight percent. These ranges for any other polymer defined herein can also be obtained by multiplying the values for poly(1-hexene) by the monomer molecular weight $M_o/84$, as described.

In general, the higher the weight average molecular weight $M_w$ for a series of polymers made from the same monomer or comonomer mixture at equivalent distribution factors, the less polymer required for a given oil to produce equivalent results. Also, the lower the viscosity of the base oil, the more polymer additive that is necessary to produce the desired viscosity specifications. The amount of the polymer specified above for addition to the lubricating oil base stock is the amount required to produce the desired change in viscosity characteristics of the automatic transmission fluid. The desired pour point characteristics are obtained within the specified ranges of copolymer additive that is required for the desired viscosity characteristics by appropriate selection of monomers and monomer proportions as specified herein.

A fully compounded automatic transmission fluid as prepared for use in automotive transmissions contains many additives that must be used to meet various specifications or to overcome various deficiencies. One advantage of the poly(1-olefin) additive described herein for improvement of the pour point and the viscosity characteristics is that it is fully compatible with and does not interfere with or detract from the functioning of other additives. Other additives which can be added to the oils are preferably those which have demonstrated their effect by actual use and include antioxidants, blooming agents, detergents, dispersants, rust inhibitors, antiwear agents, antifoaming agents, extreme pressure agents, corrosion inhibitors, sludge inhibitors, friction modifying agents, antisquawk agents, metal deactivators, antiscuffing agents, and the like. These additives are selected and used to meet desired specifications or overcome deficiencies in the base oil with respect to the intended use in accordance with procedures which are conventional and well known to those in the field of compounding automatic transmission fluids.

The poly(1-olefin)s of this invention which have the critical ranges of weight average molecular weights $M_w$, number average molecular weights $M_n$ and molecular weight distribution $M_w/M_n$ are preferably made, by catalyzing the alpha-olefin or mixture of alpha-olefins using a Ziegler-Natta type catalyst. Either continuous, semi-continuous in which only the alpha-olefin is added during reaction, or batch polymerization can be used, provided that all conditions and proportions of chemical species present in the reaction mixture are properly correlated with each other to obtain the necessary molecular weights and distribution. Any Ziegler-Natta type catalyst can be used which is useful for the polymerization of propylene. Particularly useful are solid titanium and vanadium salts, primarily the chlorides, in conjunction with aluminum alkyls and alkyl chlorides. We have found that purple titanium trichloride together with aluminum triethyl constitutes an excellent catalyst. A catalyst containing from about one to about 10 gram atoms of aluminum per gram atom of titanium is useful with a ratio of about 1.8 to about three being preferred. The reaction is suitably carried out using about 300 to about 6,000 grams of olefin per gram of catalyst and preferably from about 1,500 to about 3,000 grams of olefin per gram of catalyst.

Hydrogen or another suitable molecular chain length modifier such as zinc chloride, dialkyl zinc such as diethyl zinc, and the like helps to direct the reaction to the desired molecular weight distribution. The partial pressure of hydrogen can broadly be between about 0.1 and about 150 p.s.i. and preferably between about 0.5 and about 25 for a continuous polymerization and between about 0.5 and about 10 for a semi-continuous or batch reaction. The temperature at which the polymerization reaction is conducted can suitably be between about 100° F. (37.8° C.) and about 250° F. (121.1° C.) and preferably between about 220° F. (104.4° C.) and about 250° F.

A suitable solvent for the reaction mixture is desirable since the resulting polymer is highly viscous and can be substantially non-flowable at room temperature. Suitable solvents include hydrocarbon solvents such as butane, pentane, hexane, heptane, and the like, naphtha, gasoline fractions, kerosene, mineral oils such as gas oil fractions, furnace oil fractions, light lubricating oils, heavy lubricating oils, and the like. Organic hydrocarbon solvents such as benzene, toluene, the xylenes and the like and chlorinated hydrocarbon solvents are less preferred. The most preferred solvents are those light solvents which can be easily distilled from the product polymer or mineral oils which can be incorporated into the automatic transmission fluid together with the polymer. Since a solvent is not necessary, it can be used in amounts from zero percent to about 75 percent of total charge to the reaction and when used, it is preferably used in an amount of about 25 to about 60 percent.

Variables which effect the weight average molecular weight, the number average molecular weight or the molecular weight distribution include the reaction temperature, the partial pressure of hydrogen or the amount of other chain length modifier, the amount of catalyst, the titanium/aluminum ratio in the catalyst, the titanium compound used, the olefin to catalyst ratio, the olefin concentration, and the like. Furthermore, it is essential that certain deleterious impurities, particularly those containing oxygen such as air, water and the like be substantially excluded from the reactor if the 1-olefin polymers of the specified characteristics are to be obtained. Even minute amounts of oxygen significantly broaden the distribution. In contrast with this requirement, it is well known that it is advantageous to add trace amounts of oxygen or oxygen containing compound to the alpha-olefin polymerization reaction in order to substantially increase the yield of product per amount of catalyst used as well as the isotacticity. Therefore, trace amounts of oxygen are generally beneficial in alpha-olefin polymerization.

The polymer made by the Ziegler-Natta type catalyst contains substantially completely a head-to-tail alignment of the repeating units in the molecules forming the polymer with pendent groups on alternating carbon atoms. We have found that the purple titanium trichloride makes an isotactic poly(1-olefin) which is superior to the atactic poly(1-olefin) made by the use of brown titanium trichloride as an automatic transmission fluid additive hereunder. However, any suitable Ziegler-Natta catalyst system can be used provided that all conditions and variables are properly correlated to produce the necessary molecular weights and distribution.

We have found that automatic transmission fluids can be formulated within one or all commercial specifications from poly(1-olefin)s having the critical relationship of molecular weights, $M_w$ and $M_n$, and molecular weight distribution $M_w/M_n$ as described herein by a proper correlation of the polymer composition, its weight average molecular weight, its number average molecular weight, its molecular weight distribution, the amount of polymer that is used, the other additives that are used, and the lubricating oil base stock formulation that is used. The expressions weight average molecular weight $M_w$, number average molecular weight $M_n$, and molecular weight distribution $M_w/M_n$ are well known and useful in the field of high molecular weight polymers. A useful description of these expressions is found in Chapter 1 of THE STRUCTURE OF POLYMERS by M. L. Miller, Reinhold Publishing Corporation, (1966). In our work these expressions were determined by gel permeation chromatography using an instrument that was calibrated using known standard poly(1-hexene) fractions.

The following examples are set out to illustrate our invention and to provide a better understanding of its details and advantages. In the examples, except where specifically indicated, all reactants, solvents and catalysts were of ultrahigh purity for the reaction. The pour point determinations were made by the method described in ASTM D 97, the 210° F. and 0° F. viscosities by ASTM D445 and the −10° F. and −40° F. viscosities by ASTM D2983. The used 210° F. viscosity was determined following the ASTM D2603 sonic shear test.

The higher olefins used herein were approximately 90 weight percent of the 1-olefin specified, about eight weight percent of other olefins of the same carbon number as the specified 1-olefin primarily a vinylidene, and about one weight percent of the next lower and next higher 1-olefin. The lower olefins used herein were greater than 96 weight percent of the specified 1-alkene.

EXAMPLE 1

A series of high molecular weight copolymers of 1-hexene and 1-octadecene were made in a 30-gallon (114 liter) stainless steel reactor using a solvent extracted, dewaxed, hydrotreated lubricating oil having a 210° F. viscosity of 4.1 centistokes (cs.) as the reaction medium and polymer solvent.

In a typical example 72.8 pounds (33 Kg.) of the oil were introduced into the reaction followed by 540 grams of a six weight percent solution of triethyl aluminum in the above lubricating oil. Next 33 grams of $(TiCl_3)_3.AlCl_3$ (Stauffer Chemical Company grade AAX) were added as a slurry in about 200 ml. of the above lubricating oil. The reactor contents were brought to 240° F. (115.6° C.) at 30 p.s.i.g. (2.1 Kg/cm$^2$) total pressure under a hydrogen atmosphere over a 15-minute period. A blend of 87.9 mol percent 1-hexene and 12.1 mol percent 1-octadecene was charged to the reactor at a rate of 1.5 pounds (0.68 Kg.) per minute for 73 minutes. The resulting reaction mixture was stirred for 1 hour at the reaction conditions.

The solution was treated with a lime and water slurry to quench the catalyst and filtered to remove the quenching medium. The unreacted olefins were removed at 25° F. (−3.9° C.) and 2 mm. pressure. The yield of polymer was 88 percent. It was determined to have a weight average molecular weight $M_w$ of 92,000 and a molecular weight distribution of 6.2.

This produce was added in various amounts to a series of mixtures of a light neutral base stock (A) having a 210° F. (98.9° C.) viscosity of 4.1 cs. and a medium neutral lubricating oil base stock (B) having a 210° F. viscosity of 6.0 cs. with each solution containing 10.0 weight percent of a commercially used detergent-inhibitor additive. The viscosity data and pour point data were than obtained for these mixtures in order to evaluate the effect of varying polymer amounts and base oil composition. The results are set out in Table I in which it is noted that sample No. 3 fits within the General Motors and the Ford Motor specifications described above.

Table I

| Number | 1 | 2 | 3 | 4 |
|---|---|---|---|---|
| Polymer, wt. % | 1.0 | 1.5 | 2.0 | 2.5 |
| Base Oil, wt. % | | | | |

Table I-continued

| | | | | |
|---|---|---|---|---|
| A | 74.0 | 73.5 | 73.0 | 72.5 |
| B | 15 | 15 | 15 | 15 |
| 210° F. vis.,cs. | | | | |
| new | 5.9 | 6.5 | 7.2 | 7.8 |
| used | 5.6 | 6.1 | 6.6 | 7.3 |
| 0° F. vis., cp. | 1,290 | 1,200 | 1,310 | 1,450 |
| −10° F. vis., cp. | 2,760 | 2,790 | 3,260 | 3,600 |
| −40° F. vis., cp. | 44,150 | 46,200 | 52,900 | 69,100 |
| Pour Point, ° F. | −45 | −50 | −45 | −45 |
| Number | 5 | 6 | 7 | 8 |
| Polymer, wt. % | 1.0 | 1.5 | 2.0 | 2.5 |
| Base Oil, wt. % | | | | |
| A | 69.0 | 68.5 | 68.0 | 67.5 |
| B | 20 | 20 | 20 | 20 |
| 210° F. vis., cs. | | | | |
| new | 6.1 | 6.7 | 7.3 | 8.0 |
| used | 5.8 | 6.3 | 6.8 | 7.4 |
| 0° F. vis., cp. | 1,290 | 1,470 | 1,680 | 1,520 |
| −10° F. vis., cp. | 2,920 | 3,050 | 3,530 | 3,850 |
| −40° F. vis., cp. | 46,700 | 48,550 | 60,200 | 70,500 |
| Pour Point, ° F. | −50 | −45 | −45 | −45 |

EXAMPLE 2

A second copolymer of 1-hexene and 1-octadecene was made as described in Example 1. The copolymer was made from 13.1 mol percent 1-octadecene and 86.9 mol percent 1-hexene. Its weight average molecular weight $M_w$ was 145,000 and its molecular weight distribution $M_w/M_n$ was 8.8. This product was also added in various amounts to a series of mixtures of the light neutral base stock (A) and the medium neutral base stock (B) including 10 percent of the same detergent-inhibitor additive as described in Example 1. The viscosity data and pour point data are set out in Table II in which it is noted that sample No. 10 fits within the General Motors and the Ford Motor specifications.

Table II

| Number | 9 | 10 | 11 |
|---|---|---|---|
| Polymer, wt. % | 1.0 | 1.5 | 2.0 |
| Base Oil, wt. % | | | |
| A | 74.0 | 73.5 | 73.0 |
| B | 15 | 15 | 15 |
| 210° F. vis., cs. | | | |
| new | 6.3 | 7.1 | 8.0 |
| used | 5.8 | 6.5 | 7.1 |
| 0° F. vis., cp. | 1,290 | 1,290 | 1,330 |
| −10° F. vis., cp. | 2,710 | 3,100 | 3,700 |
| −40° F. vis., cp. | 53,500 | 51,400 | 66,400 |
| Pour Point, ° F. | −45 | −45 | −45 |
| Number | 12 | 13 | 14 |
| Polymer, wt. % | 1.0 | 1.5 | 2.0 |
| Base Oil, wt. % | | | |
| A | 69.0 | 68.5 | 68.0 |
| B | 20 | 20 | 20 |
| 210° F. vis., cs. | | | |
| new | 6.4 | 7.3 | 8.3 |
| used | 6.0 | 6.6 | 7.3 |
| 0° F. vis., cp. | 1,310 | 1,470 | 1,470 |
| −10° F. vis., cp. | 3,020 | 3,470 | 4,140 |
| −40° F. vis., cp. | 63,400 | 63,300 | 72,200 |
| Pour Point, ° F. | −45 | −45 | −45 |

EXAMPLE 3

A third copolymer of 1-hexene and 1-octadecene was made by the procedure described in Example 1. This copolymer which was made from 15 mol percent 1-octadecene and 85 mol percent 1-hexene was found to have a weight average molecular weight $M_w$ of 100,000 and a molecular weight distribution of 6.4. This copolymer was added in various amounts to the light neutral base stock (A) and the medium neutral base stock (B) plus 10 percent of the same detergent-inhibitor additive and tested as described in Example 1. The viscosity and pour point data are set out in Table III:

Table III

| Number | 15 | 16 | 17 |
|---|---|---|---|
| Polymer, wt. % | 1.0 | 1.5 | 1.5 |
| Base Oil, wt. % | | | |
| A | 74.0 | 73.5 | 68.5 |
| B | 15 | 15 | 20 |
| 210° F. vis., cs. | | | |
| new | 5.9 | 6.4 | 6.6 |
| used | 5.7 | 6.1 | 6.3 |
| 0° F. vis., cp. | 1,350 | 1,310 | 1,200 |
| −10° F. vis., cp. | 2,520 | 3,010 | 3,330 |
| −40° F. vis., cp. | 42,850 | 60,100 | 74,500 |
| Pour Point, ° F. | −45 | −50 | −50 |

EXAMPLE 4

A fourth copolymer was made from nine mol percent 1-octadecene and 91 mol percent 1-hexene by the procedure described in Example 1. This copolymer was found to have a weight average molecular weight $M_w$ of 75,000 and a molecular weight distribution of 6.8. This copolymer was also added to the light neutral base stock (A) and the medium neutral base stock with 10 percent of the same detergent-inhibitor and tested as described in Example 1. The viscosity and pour point data for this fourth copolymer are set out in Table IV:

Table IV

| Number | 18 | 19 | 20 | 21 |
|---|---|---|---|---|
| Polymer, wt. % | 2.0 | 2.0 | 2.0 | 2.0 |
| Base Oil, wt. % | | | | |
| A | 68 | 88 | 83 | 73 |
| B | 20 | 0 | 5 | 15 |
| 210° F. vis., cs. | | | | |
| new | 6.8 | 7.0 | 7.2 | 7.6 |
| used | 6.2 | 6.4 | 6.6 | 7.0 |
| 0° F. vis., cp. | 1,560 | 1,270 | 1,300 | 1,320 |
| −10° F. vis., cp. | 4,710 | 2,900 | 3,300 | 3,960 |
| −40° F. vis., cp. | solid | solid | solid | solid |
| Pour Point, ° F. | −30 | −45 | −45 | −40 |

EXAMPLE 5

Another copolymer was made from 12.1 mol percent 1-octadecene and 87.9 mol percent 1-hexene as described by the general procedure of Example 1. This polymer had a weight average molecular weight $M_w$ of 45,400 and a molecular weight distribution of 5.8. This copolymer was also added in various amounts to the light neutral base stock (A) and the medium neutral base stock (B) together with 10 percent of the detergent-inhibitor additive as described in Example 1. The viscosity and pour point determinations are set out in Table V:

Table IV

| Number | 22 | 23 | 24 |
|---|---|---|---|
| Polymer, wt. % | 1.5 | 2.0 | 2.5 |
| Base Oil, wt. % | | | |
| A | 73.5 | 73.0 | 72.5 |
| B | 15 | 15 | 15 |
| 210° F. vis.,cs. | | | |
| new | 5.8 | 6.2 | 6.6 |
| used | 5.7 | 6.0 | 6.4 |
| 0° F. vis., cp. | 1,260 | 1,290 | 1,200 |
| −10° F. vis., cp. | 2,570 | 2,860 | 3,130 |
| −40° F. vis., cp. | 42,300 | 54,000 | 76,200 |
| Pour Point, ° F. | −45 | −45 | −45 |

Table IV-continued

| Number | 25 | 26 | 27 | 28 |
|---|---|---|---|---|
| Polymer, wt. % | 1.0 | 1.5 | 2.0 | 2.5 |
| Base Oil, wt. % | | | | |
| A | 69.0 | 68.5 | 68.0 | 67.5 |
| B | 20 | 20 | 20 | 20 |
| 210° F. vis., cs. | | | | |
| new | 5.7 | 6.0 | 6.3 | 6.7 |
| used | 5.6 | 5.8 | 6.2 | 6.5 |
| 0° F. vis., cp. | 1,265 | 1,200 | 1,310 | 1,380 |
| −10° F. vis., cp. | 2,560 | 2,810 | 2,990 | 3,280 |
| −40° F. vis., cp. | 46,250 | 47,350 | 60,800 | 75,500 |
| Pour Point, ° F. | −45 | −45 | −45 | −45 |

EXAMPLE 6

A high molecular weight polymer of 1-hexene was made in a 0.5 liter stirred reactor by a continuous process. 1-Hexene was introduced into the reactor at the rate of 900 ml. per hour. A catylyst was prepared by reacting a 1.3 weight percent solution of triethyl aluminum in heptane with a 0.17 weight percent solution of $(TiCl_3)_3.AlCl_3$ (obtained from Stauffer Chemical Company and designated as titanium trichloride AA-purple crystalline) in heptane in a stirred reactor at 100° F. (37.8° C.) under 10 p.s.i.g. (0.7 Kg/cm²) of nitrogen. The catalyst stream contained a molar ratio of aluminum triethyl to titanium trichloride, $TiCl_3$, of two to one and was introduced into the polymerization reactor at the rate of 900 ml. per hour. The reactor was maintained at 240° F. (115.6° C.) and was pressured with hydrogen to a pressure of 52 p.s.i.g. (3.7 Kg/cm²). A product stream was continuously removed from the reactor at the rate of 1,500 ml. per hour which provided an average residence time for the 1-hexene in the reactor of 20 minutes.

The stream that was removed from the reactor was a mixture of poly(1-hexene), unreacted 1-hexene, heptane and trace amounts of the catalyst. The catalyst was killed by mixing a 10 percent aqueous sodium hydroxide solution with the hydrocarbon stream. The water solution was separated from the hydrocarbon solution by decantation. The hydrocarbon solution was then waterwashed, dried and filtered. The hydrocarbon solution was next mixed with sufficient light neutral oil having a 210° F. viscosity of 4.15 centistokes (cs.) to form a 50 weight percent solution of poly(1-hexene) in the oil after the 1-hexene and heptane were stripped off to a flash point of 380° F. (193.3° C.).

The poly(1-hexene) was recovered in a 70 percent yield based on the 1-hexene fed to the reactor. It was determined to possess a weight average molecular weight $M_w$ of 180,000, a number average molecular weight of 21,000 and a molecular weight distribution of 8.5. This product was mixed with the light neutral base oil (A) used in Example 1 and also with a solution of this light neutral base oil and the medium neutral base oil (B). Ten percent of the detergent-inhibitor additive used in Example 1 as well as one percent of a commercial pour point depressant were also added. The viscosity and pour point determinations of these solutions are set out in Table VI.

Table VI

| Number | 29 | 30 | 31 |
|---|---|---|---|
| Polymer, wt. % | 1.6 | 1.6 | 1.5 |
| Base Oil, wt. % | | | |
| A | 71.6 | 87.3 | 87.5 |
| B | 15.8 | 0 | 0 |
| 210° F. vis., cs. | 8.25 | 7.6 | 7.4 |
| 0°F. vis., cp. | 1,400 | 1,140 | 1,140 |
| −10° F. vis., cp. | 4,120 | 4,035 | 3,780 |
| −40° F. vis., cp. | 91,500 | 53,800 | 51,000 |

Table VI-continued

| Number | 29 | 30 | 31 |
|---|---|---|---|
| Pour Point, ° F. | −40 | −40 | −40 |

The above examples describe formulations which fit one or more commercial specifications for automatic transmission fluids as well as indicate the effect of the variables that are involved and suggest how the correlation of these variables can be accomplished for the preparation of specification material. These variables include the polymer composition, its molecular size and molecular weight distribution, the amount of polymer used, the nature and amount of other additives and the composition and properties of the lubricating oil base stock.

It is to be understood that the above disclosure is by way of specific example and that numerous modifications and variations are available to those of ordinary skill in the art without departing from the true spirit and scope of the invention.

We claim:

1. A composition comprising one or more petroleum-based lubricating oil base stocks and a minor amount of a linear alpha-olefin copolymer produced by polymerization of a lower alpha-olefin monomer having from six to 10 carbon atoms or mixtures thereof admixed with from about 10 to about 25 mol percent of a higher alpha-olefin monomer having from 16 to 20 carbon atoms or mixtures thereof with substantially all of the alternate carbon atoms in each linear copolymer chain having randomly dependent therefrom an alkyl group derived from one of the alpha-olefin monomers and having two less carbon atoms than the alpha-olefin from which it is derived, said alpha-olefin copolymer characterized by a weight average molecular weight $M_w$ between about 50,000 ($M_o$/84) and about 500,000 ($M_o$/84), a number average molecular weight $M_n$ between about 4,000 ($M_o$/84) and about 500,000 ($M_o$/84) where $M_o$ is the average molecular weight of the mixture of alpha-olefin monomers, a distribution factor $M_w/M_n$ of between one and about 12, the upper limit of said distribution factor being about 12 when $M_w$ is about 50,000 ($M_o$/84) and the upper limit of said distribution factor being about two when $M_w$ is about 500,000 ($M_o$/84) with the upper limit of said distribution factor proportionately decreasing from about 12 to about two as $M_w$ increases from about 50,000 ($M_o$/84) to about 500,000 $M_o$/84), and said composition comprising from about 0.2 $M_o$/84) weight percent to about five ($M_0$/84) percent of said alpha-olefine copolymer.

2. A composition in accordance with claim 1 in which the lower alpha-olefin is 1-hexene and the higher alpha-olefin is 1-octadecene.

3. A composition in accordance with claim 1 which contains from about 0.5 ($M_o$/84) to about 2.0 ($M_o$/84) weight percent of said copolymer.

4. A composition in accordance with claim 1 containing an effective amount of at least one or more additives selected from antioxidants, blooming agents, detergents, dispersants, rust inhibitors, antiwear agents, extreme pressure agents, corrosion inhibitors, sludge inhibitors, friction modifying agents, antisquawk agents, metal deactivators and antiscuffing agents.

5. A composition in accordance with claim 1 in which said copolymer is produced from a monomer mixture containing from about 12 to about 20 mol percent of the higher alpha-olefin.

6. A composition in accordance with claim 5 in which the lower alpha-olefin is 1-hexene and the higher alpha-olefin is 1-octadecene.

* * * * *